United States Patent [19]

Stadelhofer et al.

[11] 4,380,454

[45] Apr. 19, 1983

[54] COKING QUALITY OF COALS WITH INSUFFICIENT COKING PROPERTIES

[75] Inventors: Jürgen Stadelhofer, Dortmund; Heinz-Gerhard Franck, Bad Soden-Neuenhain; Karl H. Koch; Rolf Marrett, both of Castrop-Rauxel, all of Fed. Rep. of Germany

[73] Assignee: Rütgerswerke Aktiengesellschaft, Frankfurt, Fed. Rep. of Germany

[21] Appl. No.: 209,343

[22] Filed: Nov. 21, 1980

[30] Foreign Application Priority Data

Dec. 19, 1979 [DE] Fed. Rep. of Germany ..... 2951116

[51] Int. Cl.[3] ..... C10L 9/10; C10L 5/16

[52] U.S. Cl. ..... 44/1 B; 44/23; 201/21; 208/39

[58] Field of Search ..... 44/23, 1 F, 1 B; 208/8 LE, 39, 41; 201/21

[56] References Cited

U.S. PATENT DOCUMENTS

| | | | |
|---|---|---|---|
| 2,834,660 | 5/1958 | Eisenhut et al. | 44/23 X |
| 4,053,569 | 10/1977 | Hahn | 44/23 X |
| 4,178,215 | 12/1979 | Kiritani et al. | 44/23 X |

*Primary Examiner*—Carl F. Dees

*Attorney, Agent, or Firm*—Joseph A. DeGrandi; Richard G. Kline; Robert G. Weilacher

[57] ABSTRACT

Upgrading coke quality of coals by adding a pitch-like product with a softening point (K-S) of 90°–160° C. to the coal. The additive is obtained by treating finely divided coal or other carbon containing raw material with hydrocarbon solvents derived from coal and petroleum and then removing 2–20% of the light boiling components of the highly aromatic pitch-like product.

5 Claims, No Drawings

COKING QUALITY OF COALS WITH INSUFFICIENT COKING PROPERTIES

The invention is concerned with the use of pitch-like carbonaceous materials for the improvement of the coking properties of coals with insufficient coking ability.

Metallurgical coke is used as an essential raw material in the production of pig-iron, and is produced by the coking of suitable coal in horizontal coke ovens. However, metallurgical coke can only be produced from a limited number of types of coal. These coals are described in the international coal classification with the numbers 433 and 434; they have a volatiles content between 24 and 28%.

Worldwide, the fraction of first-class coking coal makes up, however, only about 5% of the coal resources, while a further 15% can be coked only to a restricted extent without pretreatment. In practice, blends of high-volatile and lean coals have therefore been utilized for a long time in order to obtain optimum coking properties.

However, the use of coal blends does not in every cse guarantee an optimum coking ability and a good coke quality. For example, if the Roga baking number is insufficient, the resulting coke exhibits excessive wear (Micum Drum strength $M_{10}$) or too low a strength (Micum value $M_{30}$ or $M_{40}$).

Because of the great and unceasing future demand for metallurgical coal, it is necessary to make the excess of coal with poor coking ability cokable by use of suitable additives or processes, in order to be able to use further types of coal as well as the true coking coals for metallurgical coke production.

As regards the thermal and mechanial pretreatment of coal (preheating or crushing operation), bituminous petroleum and coal-derived coking coal improvement media were proposed in the past (cf. K. G. Beck, I. Meckel, *Glückauf* 115 (1979), pp. 979–983) to obtain improved coking ability.

Thus in DE-OS 2,643,519 a process is described according to which a pitch is produced from a heavy petroleum oil fraction by thermal and chemical aromatization, and the coal to be improved can be converted with it into good metallurgical coke. The disadvantage of this process is that the petroleum oil residue cannot be used directly as the improving medium, but has to be converted, by an environmentally damaging and thermally costly process into a suitable additive.

Use of an improvment medium derived from coal is described in British Patent No. 1,528,546. In this process, a coal extract produced from anthracene oil and coal is recommended as a coking coal improving medium. The disadvantage of this process is, however, that the economic use matched to the greatest need is very restricted, on account of the preferred use of anthracene oil as a chemical raw material for the recovery of high-value dyestuff intermediates.

Coal tar pitch, which is used with success as a coking coal improvement medium (cf. loc. cit 1) is also in limited supply for this purpose likewise, since it is preferred as a high-value, low-ash raw material for the production of pure carbon products.

A process is described in DE-OS No. 2,164,474 in which petroleum distillate residues or petroleum-derived extraction residues are used in amounts of 1–40 wt. percent as the coking coal improvement medium.

The disadvantage of this manner of proceeding is that the petroleum-derived coking coal improvement medium, with low aromaticity, must first be subjected to an expensive thermal aromatization, while the limitation mentioned above holds for the products based on coal tar.

Because of the shortage, mentioned above, of self-coking coals and the disadvantages, as described, of the previously proposed coking coal improvement media, there is a pressing need for coal additives which do not possess the disadvantages mentioned and which equal the already known good improvement properties of coal tar pitch.

The object of the present invention is therefore to find a coking coal improvement medium such that the use of coal even with insufficient coking properties is made possible for the production of metallurgical coke in the coke oven.

According to the invention, this object is achieved by the use of a coking coal improvement medium obtained by distilling off 2–20% light-boiling components from the highly aromatic, pitch-like carbonaceous material which can be obtained by the disintegration of comminuted coal and/or similar carbon-containing raw materials with a combination of hydrocarbon mixes as solvent, derived from coal and petroleum, with the use of elevated temperature and pressure conditions. The pitch-like product thus obtained, with a softening point (Krämer-Sarnow) of 90°–160° C. is mixed in accordance with the invention, in an amount of 1–20 weight percent, preferably 3–12 weight percent, with a coal or coal blend with insufficient coking properties, and the coking is carried out in a high-temperature oven.

The production of the highly aromatic carbonaceous materials as starting pitch is the object of an earlier patent application, No. P 2,935,039.8, of the present assignee, corresponding to U.S. Ser. No. 171,203, filed July 22, 1980, the entire disclosure of which is relied upon herein and incorporated by reference. This effects disintegration of coal with high or low volatiles content with aromatic residues from the steam pyrolysis of petroleum fractions in combination with coal-derived aromatic mixtures with an average boiling point above 350° C. as complementary solvent, possibly with the additon of further solvents. Preferably, 10–15% of light-boiling fractions are distilled off. The softening point of the final pitch thus obtained, 90°–160°, is substantially determined by the degree to which these lighter-boiling materials are driven off.

The carbonaceous material used for improvement according to the invention can be added, when coal blends are used, either to one of the coals or after the coals are blended,. The coking coal improving medium according to the invention is of particular advantage here, since it has good granulation and storage properties, making possible admixture in solid and liquid form. The coking coal additive according to the invention corresponds in this respect to the coal tar pitch recommended for coking coal improvement.

The production of the coking coal improvement medium according to the invention and its use is described in Examples 1 through 3.

As the coal blend to be improved there was used a blend of 70% of a high-volatile coal (37% volatiles, dry ash free, international classification number 632) and 30% of a lean coal (19% volatiles, international classification number 332). The coal blend was coked with 4 to 8% additive in a 7 kg experimental coke oven at 1,000°

C. for 5 hours. The coke produced was subjected to the standardized Micum Drum test for determination of the $M_{10}$ and $M_{30}$ values.

The values for the piece strength $M_{30}$ and wear $M_{10}$ of the coke obtained with the addition of 8% of improvement medium according to the invention, are given in the table.

For comparision, a corresponding coking coal blend without any addition and a similar coking coal blend to which 15% coal extract based on anthracene oil was added, according to British Patent No. 1,528,546, were made use of. The coke to be compared was produced under comparable conditions, respectively, with reference to coking apparatus and temperature and time conditions.

EXAMPLE 1

Corresponding to the methods described in the earlier patent application, No. P 29 35 039.8, a pitch-like carbonaceous material was produced by disintegration of 30 parts by weight of high-volatile coal (international classification No. 611) (Westerholt type, Ruhr) with 35 parts by weight of pyrolysis residue from the cracking of crude light petroleum, 10 parts by weight of pitch distillate from the flash distillation of coal tar pitch, and 25 parts by weight of pitch distillate from the heat and pressure treatment of coal tar pitch. The mixture was here exposed to a reaction temperature of 370° C. and a maximum pressure of at most 30 bar and a reaction time of 3 hours. 15 parts by weight of the pitch obtained in this was were distilled off. The carbonaceous material thus obtained is characterized by the following data: S.P. (K.S.) 109° C.; sulfur, 0.6%; ash, 2.7%; QI, 10.4%. Here S.P. means the softening point as determined by Krämer-Sarnow and QI, insolubles in quinoline.

This carbonaceous material was added in a proportion of 4 weight percent of the above-specified coking coal blend to be improved, of 70% high-volatile and 30% lean coal, and coking was carried out in a research oven taking 7 kg of material quantity, at 1,000° C. and a coking time of 5 hours. The quality of the coke obtained can be seen from the table.

EXAMPLE 2

The procedure is the same as in Example 1. The coking coal improvement medium was, however, 8 weight percent carbonaceous material, which was produced as described in Example 1, and added to a coking blend with the specification described previously. The quality of the coke obtained may be seen from the table.

EXAMPLE 3

The procedure was the same as in Example 1. However, the following solvent mixture was used for disintegration: 35 parts by weight of pyrolysis residue from the cracking of gas oil, 25 parts/wt. pitch distillate from the treatment with heat and pressure of coal tar pitch, and 10 parts/wt. of filtered anthracene oil (cf. H. G. Franck, G. Collin, *Steinkohlenteer* [Coal Tar], Berlin 1968, page 57). By distilling off 12 parts by weight, a carbonaceous material is obtained with a softening point of 113° C. Further characteristic data are: sulfur, 1.9%; ash, 2.8%; QI, 10.2%.

This carbonacoues material was added in a proportion of 8 parts by weight of the coking coal blend to be improved, consisting of 70% of a high-volatile coal (37% volatiles, international classification No. 332) and was coked under the same conditions as described in Example 1. The coke quality can be seen from the table.

TABLE

| Oven Charge | | Micum Index of Coke Product $M_{10}$ | $M_{30}$ |
|---|---|---|---|
| 1. | Coal blend of specified kind, with 4% carbonaceous material according to Example 1 | 10 | 80 |
| 2. | Coal blend of specified kind, with 8% carbonaceous material according to Example 1 | 10 | 82 |
| 3. | Coal blend of the specified kind, with 8% carbonaceous material according to Example 2 | 10 | 88 |
| 4. | Coal blend of the specified kind, without addition | 11.5 | 78 |
| 5. | Coal blend corresponding to the specification according to British Patent No. 1,528,546, with the addition of 15% coal extract (anthracene oil) | 11 | 83. |

Further variations and modifications of the foregoing invention will be apparent to those skilled in the art after reading this specification and are intended to be encompassed by the claims which follow.

What is claimed is:

1. In a process for upgrading the coke quality of coals with insufficient coking properties, the improvement comprising mixing with said coal a coking coal improvement medium which is a pitch-like product with a softening point (Krämer-Sarnow method) of 90°–160° C., and is obtained from the highly aromatic carbonaceous material produced by the disintegration of comminuted coal and/or similar coal-like raw materials with a combination of hydrocarbon mixtures as the solvent which are aromatic residues from the steam pyrolysis of petroleum fractions in combination with coal-derived aromatic mixtures with an average boiling point above 350° as complementary solvent, with the use of elevated temperature and pressure conditions, and by distilling off 2 to 20% of light-boiling components.

2. The process according to claim 1, wherein pressure of up to 50 bar and temperatures between 250° and 420° C. are used.

3. The process according to claims 1 or 2, characterized in that 3–12 weight percent of the pitch-like product is mixed with the coal before coking.

4. The process according to claims 1 or 2, wherein a highly aromatic pitch-like hydrocarbon is utilized from which 10–15% of volatile components have previously been distilled off.

5. An additive for the improvement of the coke quality of coals with insufficient coking properties, comprising the pitch-like product with a softening point (Krämer-Sarnow method) of 90°–160° C. which is obtained from the highly aromatic carbonaceous material obtained by the disintegration of comminuted coal and/or similar coal-like raw materials with a combination of hydrocarbon mixtures as the solvent, which are aromatic residues from the steam pyrolysis of petroleum fractions in combination with coal-derived aromatic mixtures with an average boiling point above 350° as complementary solvent, with the use of elevated temperature and pressure conditions, and wherein from 2 to 20% of light-boiling components are distilled off.

* * * * *